US005251260A

United States Patent [19]

Gates

[11] Patent Number: 5,251,260

[45] Date of Patent: Oct. 5, 1993

[54] AUDIO SURROUND SYSTEM WITH STEREO ENHANCEMENT AND DIRECTIVITY SERVOS

[75] Inventor: Stephen F. Gates, Mission Viejo, Calif.

[73] Assignee: Hughes Aircraft Company, Los Angeles, Calif.

[21] Appl. No.: 741,692

[22] Filed: Aug. 7, 1991

[51] Int. Cl.[5] ..... H04R 5/00

[52] U.S. Cl. ..... 381/18; 381/1; 381/24; 381/27

[58] Field of Search ..... 281/1, 18, 24, 27, 22

[56] References Cited

U.S. PATENT DOCUMENTS

| | | | |
|---|---|---|---|
| 4,408.095 | 10/1983 | Ariga et al. | 381/24 |
| 4,748,866 | 5/1988 | Klayman | 381/1 |
| 4,841,572 | 6/1989 | Klayman | 381/17 |
| 4,853,213 | 8/1989 | Tasaki et al. | 381/27 |
| 4,866,774 | 9/1989 | Klayman | 381/1 |

*Primary Examiner*—John K. Peng
*Assistant Examiner*—Edward Lefkowitz
*Attorney, Agent, or Firm*—Georgann S. Grunebach; Terje Gudmestad; Wanda K. Denson-Low

[57] ABSTRACT

A audio surround system particularly arranged for use in a theater provides the enhanced ambience and wide sound image advantages of a stereo enhancement system (SRS system) having directivity servos. A stereo enhancement system known as the "SRS" enhancement system enables a pair of relatively closely spaced speakers to provide a wide sound image lacking in any apparent point source and having enhanced directivity. A first SRS system (10) is modified for use with a set of front speakers (16,22,26) by increasing speed of its directivity servos (80), minimizing "pumping" caused by the increased directivity servo speed, increasing its threshold, and providing a bleed for minimizing reverberation effect. A similar SRS system (34) drives a set of rear speakers (40,46,50) and is differently modified to eliminate certain high pass filters (86,110), increase speed of its directivity servos (80), and to feed only ambience signals to left and right rear speakers (40,46). Center sound, the sum signal from the rear SRS system (34), is fed to a sub-woofer (50).

12 Claims, 4 Drawing Sheets

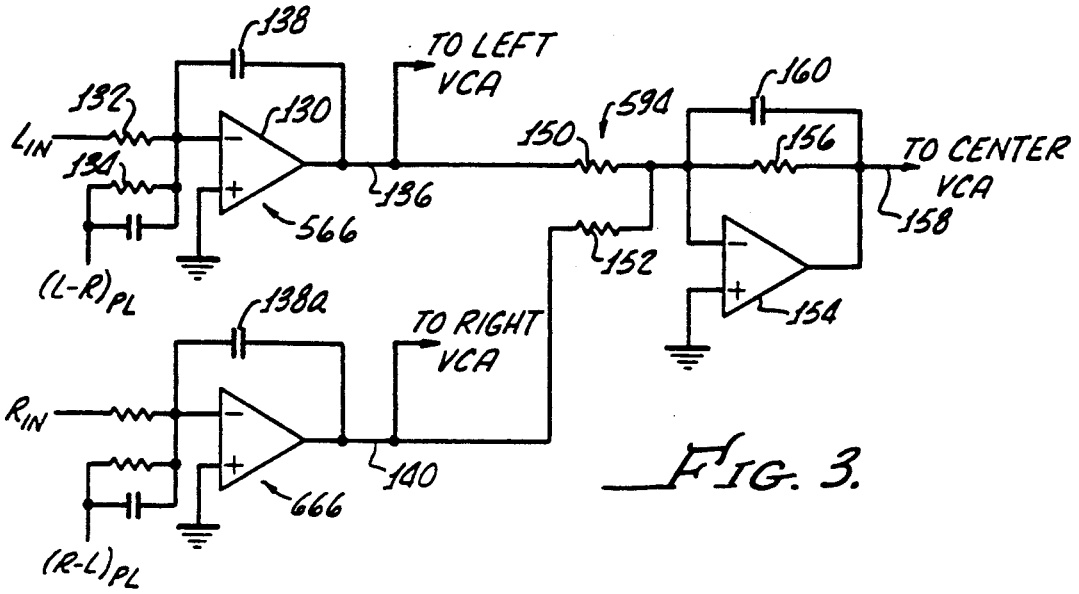
FIG. 3.
FIG. 4.
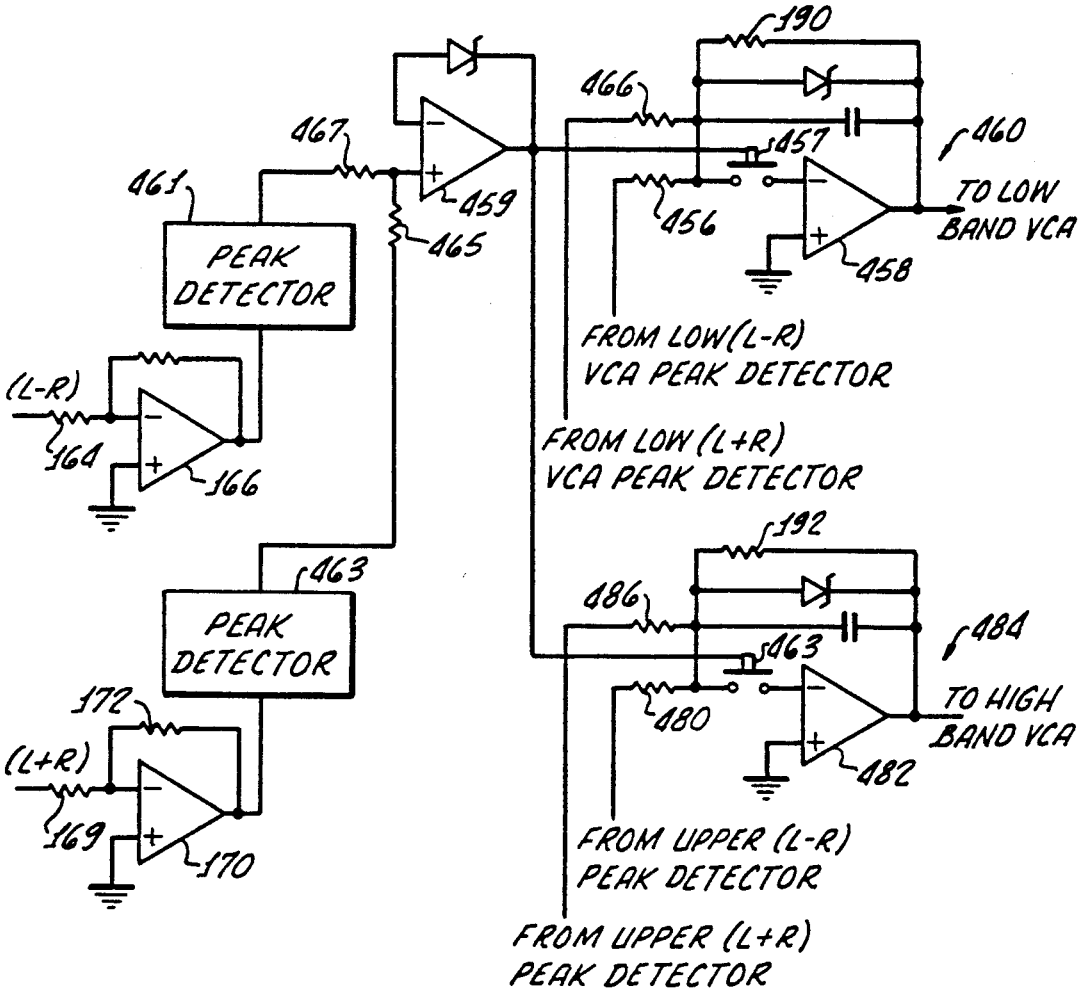

AUDIO SURROUND SYSTEM WITH STEREO ENHANCEMENT AND DIRECTIVITY SERVOS

This application is related to U.S. Pat. No. 4,748,669 for Stereo Enhancement System, issued May 31, 1988, and to U.S. Pat. No. 4,866,774, for Stereo Enhancement and Directivity Servo, issued Sep. 12, 1989, both assigned to the assignee of the present application. The disclosures of these prior patents are incorporated by this reference as though fully set forth herein.

BACKGROUND OF THE INVENTION

1. Field of the Invention

The present invention relates to stereo sound image enhancement, and more particularly concerns methods and apparatus for providing surround sound having enhanced directivity and enhanced ambience.

2. Description of Related Art

Surround sound systems endeavor to provide more realistic sound imaging and to have the listener experience the sound as if he were positioned within the area of action depicted by the sound. Such surround sound systems are, at present, more commonly employed in large chambers, such as movie theaters and the like, but are finding ever increasing application in home stereo systems.

Typically, a surround system employs a set of speakers at the front of the theater and a set of speakers at the rear of the theater. Additional speakers along the theater sides may be employed. Many different techniques have been suggested and are presently used for processing sound signals, whether stereo or monaural, and feeding these to front and rear speakers of the theater speaker system.

Signals fed to front and rear speakers must be processed differently in order to keep the listener's attention focused at the front of the theater where the visual display is located. In a movie theater, for example, the action is seen at the front and sound is heard from the front. At the same time, surround sound is provided from the rear or sides to augment ambience, width and scope of the sound image while attempting to maintain primary attention of the listener directed to the front of the theater.

Prior systems arranged to provide surround sound include DOLBY surround, DOLBY pro-logic and FOSGATE systems. In the DOLBY system, for example, four uniquely prepared surround input channels, including left, right, center and surround channels, are matrixed down to two channels by a stereo matrix encoder. These two channels are provided as a sound source, either broadcast or fixed on a sound recording medium, such as a record, tape, compact disc or the like. Left and right front channels are not altered, but a center channel, representing the sum of left and right channels, is used at a level of 3 db down, for obtaining equal loudness considerations, and is added to both right and left side information. A surround channel, also reduced by 3 db, is shifted in phase plus or minus 90° for left and right channel information.

The two output signals, e.g. left and right channels, can be fed from the sound source to a variety of speaker systems. They can be fed to a monaural system, a conventional stereo speaker system having left and right speakers, or to a specific surround speaker system particularly arranged for maximum utilization of the pair of matrixed DOLBY surround signals. However, for use in such a surround speaker system, a decoding or dematrixing circuit is required to process the two output signals for transmission to the front and rear speakers of the theater or the like.

Such surround systems are considered by many to provide significant improvement in large theater sound, but, nevertheless, exhibit a significant weakness in their attempted realistic sound production. This weakness is due to the fact that the sound often appears to emanate from a point source in such systems. Sound heard by persons seated at one location in the theater may be quite different from sound received by a person seated at a different location. Generally in such systems a seat in the center toward the front provides maximum desirable effect of the surround sound.

The point source problem is caused, in part, by the fact that sound coming from one speaker is louder when it reaches the listener if the listener's position is closer to such one speaker. Thus, for example, a person sitting at the rear of the theater, close to one of the rear speakers, may find that sound coming from the closest rear speaker tends to dominate sound that he receives from speakers at the front. This tends to focus the listener's attention at a point at the rear of the theater closer to his seat rather than at the front of the theater where the visual activities occur. This is undesirable.

This point source problem is alleviated to some extent by taking advantage of the Haas effect, which recognizes that one sound reaching a listener prior to a second sound tends to dominate the second sound, and that relative intensities of the two sounds at the listener may be somewhat compensated by interjecting relative time delay. Accordingly, sound sent to speakers in the rear of the theater is commonly delayed to some extent in attempts to maintain focus of the listener's attention at the front of the theater. Thus front emanating sounds may reach the listener in the rear before he hears rear emanating sounds, and therefore at least partially compensate for his greater proximity to the rear speakers. Nevertheless, despite such attempts, the point source effect, which tends to localize sound sources at individual speaker locations, still predominates. A related problem is the fact that the sound image provided to the listener in the theater varies with seat location.

Accordingly, it is an object of the present invention to provide a surround system that avoids or minimizes above mentioned problems.

SUMMARY OF THE INVENTION

In carrying out principles of the present invention in accordance with a preferred embodiment thereof, first and second stereo enhancement systems are provided to process sound signals for respective sets of front and rear speakers. The two processing systems are differently arranged to process the front and rear sounds differently so that the front sounds will provide clear and clean center stage sound image with a significant degree of ambience and increased directivity, whereas the rear sounds are processed to enhance the directivity and ambience without providing center stage sound components. The rear sound enhancement system provides center stage sound components only at very low frequencies to a sub-woofer, which has little directionality.

BRIEF DESCRIPTION OF THE DRAWINGS

In the accompanying drawings:

FIG. 3 illustrates certain circuits of the enhancement system of FIGS. 2a and 2b as modified to increase speed (response time) of the directivity servos and to eliminate pumping due to the increased speed; and FIG. 4 illustrates portions of circuitry of an enhancement system which is modified to increase its threshold and to decrease reverberation effects.

DESCRIPTION OF THE PREFERRED EMBODIMENT

The surround systems to be described herein take advantage of improved stereo sound enhancement capabilities of systems described in prior U.S. Pat. No. 4,748,669 for Stereo Enhancement System and U.S. Pat. No. 4,866,774 for Stereo Enhancement and Directivity Servo, both invented by Arnold I. Klayman and assigned to the assignee of the present application. The later U.S. Pat. No. 4,866,774, is an improved version of the system described in the earlier patent. It is the system described in the later patent for Stereo Enhancement and Directivity Servo that is modified, as will be described below, to provide a surround system that takes advantage of the wide ambience and suppression of apparent point sources, together with improved directionality that is accomplished by the system of the Klayman patents. Systems of these patents are commonly known as "SRS" or sound retrieval systems.

Briefly, as described in U.S. Pat. No. 4,866,774, stereo enhancement and a wide non-directional sound image is provided by boosting lower and upper frequency bands of the difference signal (L−R), where L and R indicate left and right stereo channel signals, also providing a predetermined fixed ratio of boosted difference signal to the sum signal (L+R), and feeding these signals to left and right speakers. This processing provides for greater ambience and a sound image that has a greatly increased width. The sound image of the SRS system appears substantially the same to the listener regardless of his position with respect to the pair of speakers. The listener hears the same sound image at any one of a great many different positions with respect to the speaker. There is effectively no "point source" effect. In addition to this increased ambience and wider sound image, directionality of the sound produced by the system is greatly enhanced so as to create greater realism for visual action that occurs at one side or the other of the screen. Directionality is increased by suitably and controllably magnifying sound that primarily appears to come from one side of the screen or the other through the use of the directivity servos described in U.S. Pat. No. 4,866,774. Such enhanced effects are provided by the system of this patent, even where it is employed with a single pair of relatively closely spaced speakers, such as, for example, stereo speakers built into a home television set.

According to the present invention, the SRS system of U.S. Pat. No. 4,866,774 is modified for use in a surround system, whether such surround system is used in a cinema application or for home video, such as television, video recorders and home surround processors and the like. No dematrixing of surround signals is required. A more detailed description of an SRS system is provided below in connection with the block diagram of FIGS. 2a and 2b and circuits of FIGS. 3 and 4. A full and complete description and explanation of the SRS system is found in U.S. Pat. No. 4,866,774.

Figure 1:
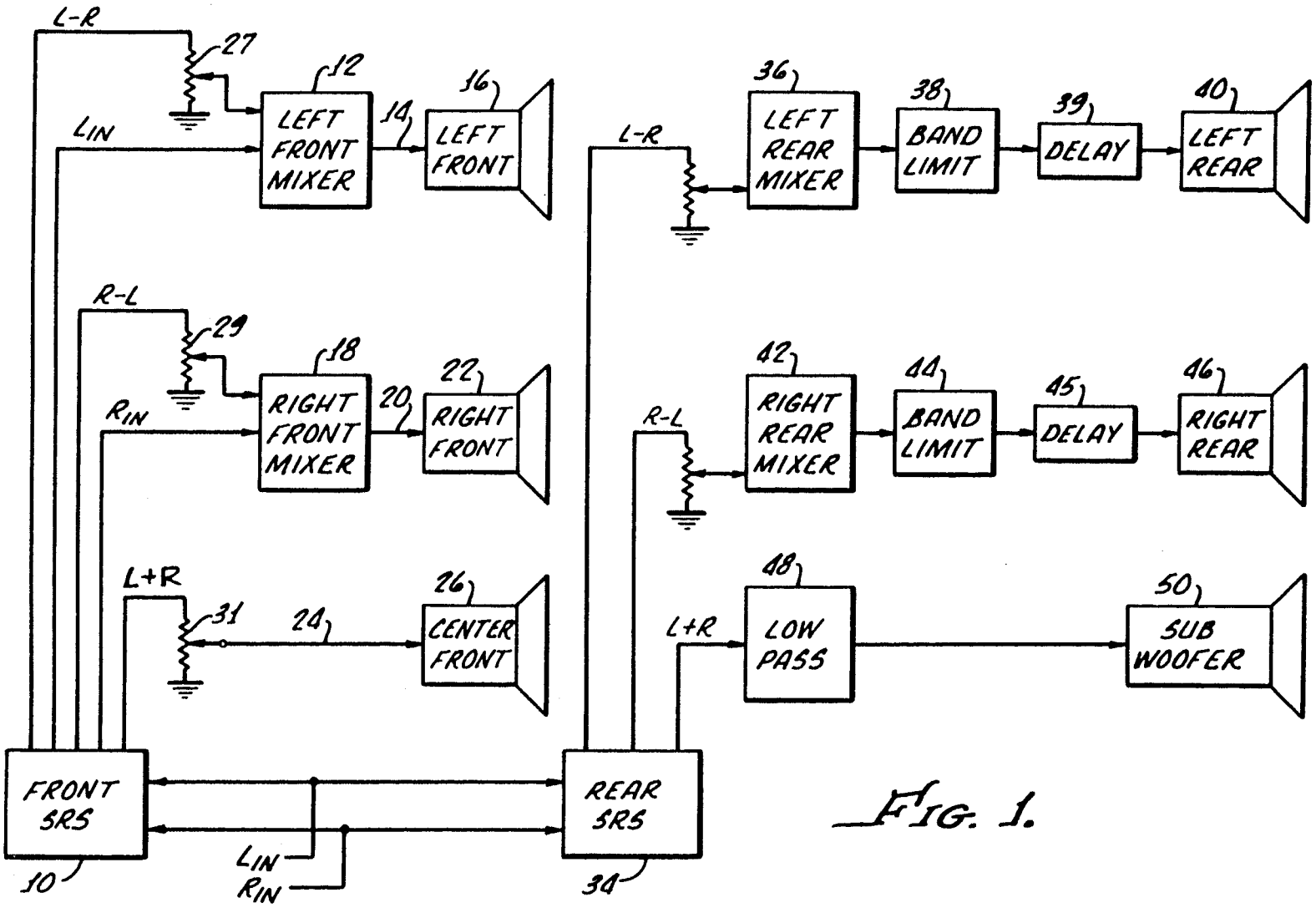
FIG. 1 is a simplified block diagram of the use of two stereo enhancement systems to drive sets of front and rear speakers.

To apply the improvements and enhancements of the SRS system to a surround sound system, two SRS systems are employed, each differently modified, as will be described particularly below, and each arranged respectively to feed separate sets of front and rear speakers. Such a dual SRS system in broad concept is illustrated in FIG. 1 in a surround sound arrangement. The two SRS systems 10 and 34 are responsive to a pair of input signals identified as $L_{IN}$ and $R_{IN}$. These input signals may be any pair of stereo signals and may indeed both be derived from a single monaural signal if provision for manufacture or generation of synthetic stereo signals is made, as described in U.S. Pat. No. 4,841,572 for Stereo Synthesizer. The two input signals also may be the two signals from an encoded and matrixed surround system, such as those provided by DOLBY surround, DOLBY pro-logic, FOSGATE, and similar systems. However, no dematrixing is needed in the present arrangement. These two left and right channel surround signals, as described above, contain sound information that is specifically configured for surround systems, and such signals are preferred as inputs for the surround system to be described herein.

Referring to FIG. 1, a front enhancement or front SRS system 10 receives the input signals $L_{IN}$ and $R_{IN}$ and provides five output signals, $L_{IN}$ and $R_{IN}$, which are the initial input signals to the SRS system, difference signals (L−R) and (R−L), which are opposite polarity difference signals (e.g. the difference between $L_{IN}$ and $R_{IN}$), and a sum signal, (L+R), which is the sum of the two input signals. In the SRS system, as employed for surround sound, the outputs (L −R) and $L_{IN}$ are mixed in a left front mixer 12, which provides an output on a line 14 to a left front speaker 16 positioned to the left at the front of the theater. A right front mixer 18 receives the difference signal (R−L) and combines this with the right input signal, $R_{IN}$ to provide a right channel output on a line 20 to a right front speaker 22 positioned at the right of the front stage. The sum signal itself, without any of the left or right components, is fed via a line 24 to a center front speaker 26 positioned at the center of the front stage. The several signals may be amplitude adjusted by potentiometers indicated at 27, 29, and 31 interposed between the output of front SRS system 10 and the input to the mixers and center front speaker. The mixers and potentiometers are part of and contained within the SRS system, but are separately illustrated in FIG. 1 for purposes of exposition.

The same input signals, $L_{IN}$ and $R_{IN}$, are applied to a second or rear SRS system 34, having outputs as sum and difference signals (L+R), (L−R) and (R−L). As shown in FIG. 1, the signal (L−R) is fed to a left rear mixer 36 and thence through a band limiting filter 38 and a delay circuit 39 to a left rear speaker 40. Similarly, the right signal (R−L) is fed to a right rear mixer 42, and thence through a band limiting filter 44 and a delay circuit 45, to a right rear speaker 46. No sum or center signal is fed to either of the left or right rear speakers. The sum signal (L+R) is fed through a low pass filter 48 to a sub-woofer 50. The left and right rear speakers are located at the rear of the theater, at left and right sides, respectively, whereas the sub-woofer can be located at any desired location within the theater, because it provides an effectively non-directional source of sound.

Figure 2A:
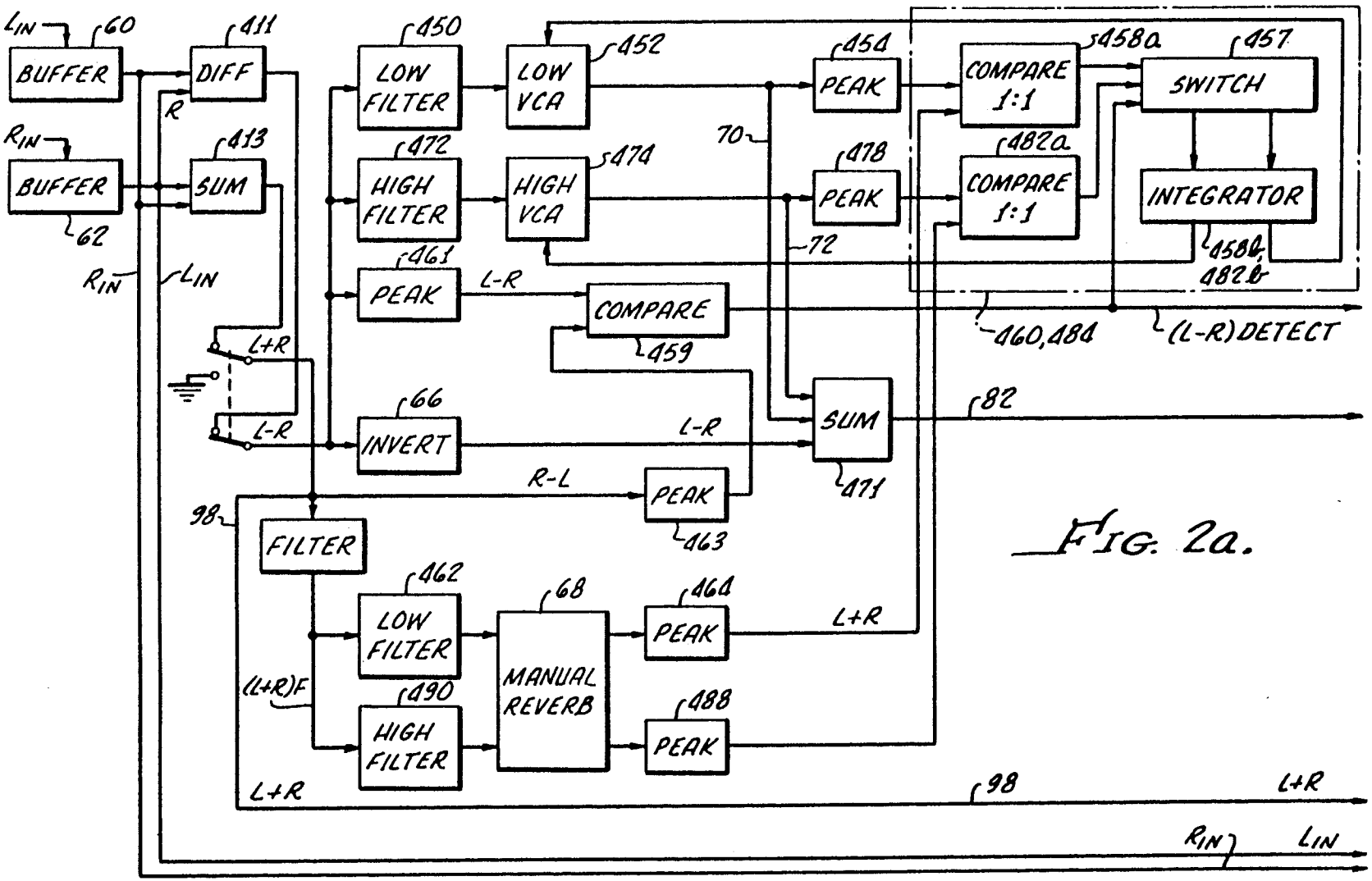
FIGS. 2a and 2b collectively comprise a detailed block diagram of a single stereo enhancement system of the type employed in FIG. 1.
Figure 2B:
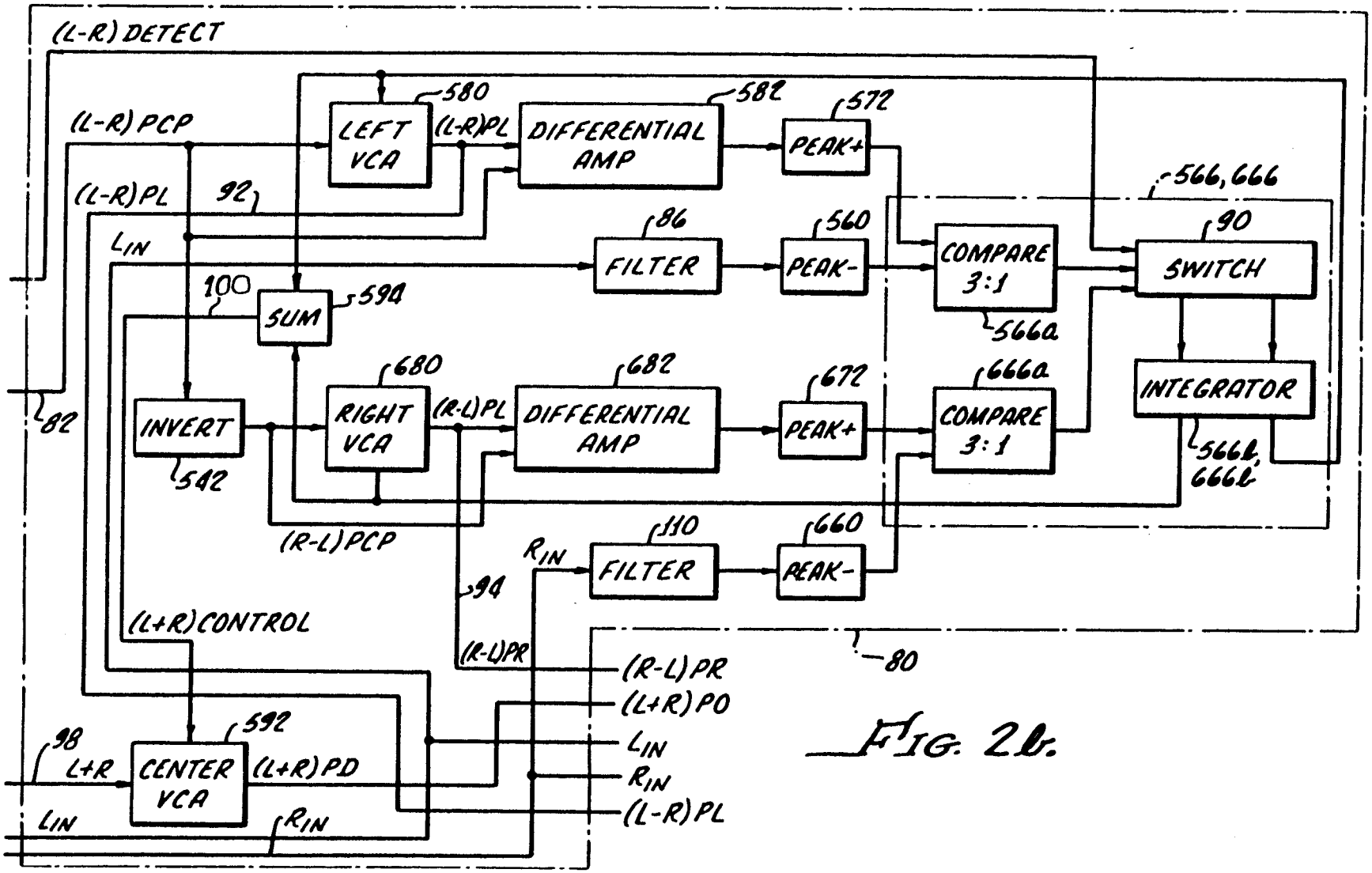

The SRS shown in FIGS. 2*a* and 2*b* represents both front and rear SRS systems employed herein. The individual front and rear SRS systems are modified in a mutually different manner, as described below, but the common block diagram of FIGS. 2*a* and 2*b* will be used as a background for understanding specific circuit details of the modifications.

The two SRS systems for front and rear are modified. Each is modified in a different fashion as compared to each other and to the system of U.S. Pat. No. 4,866,774. Briefly, these modifications for the front SRS system comprise (a) speeding up of the directivity servos and concomitant suppression of a pumping effect caused by the speed up, (b) raising of the processing threshold, (c) decreasing reverberation effect by bleeding the control signal to the servoed equalizers of the enhancement circuit, and (d) feeding the center front speaker solely with center sound image or (L+R). These modifications will be explained in detail below in connection with the circuitry of FIGS. 3 and 4.

Modifications of the rear SRS system 34 are somewhat different. The directivity servos have increased speed but no suppression of directivity servo effect (pumping) on the center signal is provided, because of the way the rear SRS system is employed. Further, the rear system is allowed to operate on a full spectrum of input signals, whereas the front system is provided with a high pass filter that passes input above 250 hertz. Outputs of the left and right rear mixers 36 and 42 are band limited to approximately 10 kilohertz so as to roll off at this frequency, and no sum signal or center sound image is fed to either of the left or right rear speakers 40,46. The center sound or sum signal L+R is fed through a low pass filter 48 that passes signals up to but not greater than about 100 hertz for transmission to the sub-woofer. With no center sound image provided, except from the sub-woofer, the servoed equalizers need not be bled (as in the modification of the front system) to decrease reverberation to the rear speakers.

Specific details of the several modifications and further discussion of effects thereof and reasons therefore will be described below in connection with the description of specific circuits that are modified. As background for understanding the modifications, a brief description of a typical SRS system will be provided in connection with the block diagrams of FIGS. 2*a* and 2*b*.

With FIG. 2*b* placed to the right of and in line with FIG. 2*a*, the two sheets of drawing collectively illustrate a single SRS system. The system illustrated in FIGS. 2*a* and 2*b* is substantially identical to the Stereo Enhancement and Directivity Servo described in U.S. Pat. No. 4,866,774, and, in particular, includes the servoed equalizers of FIG. 9 and the directivity servos of FIG. 12 of U.S. Pat. No. 4,866,774. The low frequency band and high frequency band servoed equalizers are shown in FIG. 2*a*. Components shown therein are analogous to the servoed equalizers of FIG. 9 of U.S. Pat. No. 4,866,774 and employ like reference numerals for ease of comparison. Input signals $L_{IN}$ and $R_{IN}$ are fed through buffers 60 and 62 to a difference circuit 411 and summing circuit 413. The difference signal (L−R) from circuit 411 is applied through low and high frequency pass filters 450 and 472, to a peak detector 461 and to an invertor 66. Outputs of filters 450,472 are fed to low band and high band voltage controlled amplifiers (VCA) 452 and 474, the outputs of which are fed to peak detectors 454 and 478. The sum signal (L+R) is fed through low and high frequency filters 462 and 490 to a manual reverberation control 68 which is operable to accomplish manual attenuation of the sum signal, and thence to peak detectors 464 and 468, of which the outputs are fed to comparison circuits 458*a* and 482*a*. Outputs of peak detectors 454 and 478 are also fed to comparison circuits 458*a* and 482*a*, which accordingly compare and combine the respective inputs thereto. Outputs of circuits 458*a* and 482*a* (which form part of an integrator, which is within dotted box 460) are fed through a switch 457 to integrating circuits 458*b* and 482*b* for the respective low and high band servoed equalizers. Outputs of the high and low band servoed equalizers, from integrating circuits 458*b* and 482*b*, are fed back to the control input of the low and high band voltage controlled amplifiers 452 and 474, respectively, so as to control the amplification provided by each of these amplifiers. The resulting outputs of VCA's 452 and 474 on lines 70 and 72 provide left and right processed and enhanced stereo signals in low and high frequency bands respectively. The net result is to amplify those frequency components of the difference signal that are normally quieter, namely those that are in lower (below about one KHz) and upper (above about six KHz) frequency bands. The comparison with the sum signal ensures a predetermined fixed relation between the difference and sum signals, all as described in greater detail in U.S. Pat. No. 4,866,774.

The processed high and low difference signal outputs on lines 70 and 72 are summed in a summing network 471, together with the unprocessed (R−L) signal from the difference circuit, and the summed outputs are fed to a pair of directivity servos, generally indicated in box 80 (FIG. 2*b*).

The purpose of the directivity servos is to sense increase in sound that predominantly emanates from the right or the left and to enhance such increase, thereby to greatly increase the apparent directivity of the sound. Accordingly, the processed and combined difference signals $(L-R)_{PCP}$ from the servoed equalizers are fed on a line 82 to the directivity servos of FIG. 2*b*.

In FIG. 2*b*, reference numerals of FIG. 12 of U.S. Pat. No. 4,866,774 are employed for corresponding components to facilitate comparison. The processed difference signal on line 82 is fed to a left channel voltage controlled amplifier (VCA) 580, the output of which $((L-R)_{PL}$ is fed to a differential amplifier 582, which receives as a second input the processed difference signal $(L-R)_{PCP}$ on line 82. The output of the differential amplifier is fed to a peak detector 572 and thence to the comparison circuit 566*a* of an integrator illustrated by components within dotted box 566,666. The comparison circuit 566*a* receives as a second input the input signal $L_{IN}$ via a high pass filter 86, which passes frequencies above 250 Hz, and a peak detector 560.

The difference signal on line 82 is fed via an invertor 542 which provides the inverted processed difference signal $(R-L)_{PR}$ to a right channel voltage controlled amplifier 680, the output of which is fed to a differential amplifier 682 having an output to a peak detector 672, which in turn provides one of the inputs to a second or right channel comparison circuit 666*a* of an integrator generally indicated within dotted box 566, 666. A second input to comparison circuit 666*a* is the right channel input signal $R_{IN}$, fed via a high pass filter 110, which passes frequencies above 250 Hz, and a peak detector 672. The outputs of the comparator circuits 566a and 666a are fed via a switching circuit 90 to integrators 566 and 666 of the respective left and right directivity servos.

Outputs of the integrator 566, 666 are fed back to control inputs of the respective voltage controlled amplifiers 580 and 680, which provide directivity enhanced difference signals $(L-R)_{PL}$ and $(R-L_{PL}$, respectively, on lines 92 and 94.

A directivity enhanced sum signal is also employed. It is obtained by feeding the sum signal on a line 98 (from sum circuit 413, FIG. 2a) to a center voltage controlled amplifier 592, which receives its control signal (L+R) CONTROL on a line 100 from a summing or averaging circuit 594. The latter receives and combines its inputs which are the control signals fed from the outputs of integrators 566, 666 back to the left and right voltage controlled amplifiers 580, 680. Accordingly, the outputs of the system illustrated in FIGS. 2a and 2b are right and left processed difference signals $(R-L)_{PR}$ and $(L-R)_{PL}$, a sum signal $(L+R)_{PD}$ and left and right input signals $L_{IN}$ and $R_{IN}$, as indicated in FIG. 2b. These signals are applied to sets of front and rear speakers as described above and illustrated in FIG. 1.

A first modification of the SRS system for the front speakers is illustrated in FIG. 3. This comprises increasing speed (decreasing response time) of the directivity servos and also suppressing the "pumping" or center sound stage component fluctuation that accompanies increased directivity servo speed. FIG. 3 illustrates circuits of portions of the directivity servos illustrated in FIG. 2b. Thus, left channel integrator 566 of FIG. 2b comprises a differential amplifier 130, having a summing network input comprised of resistor 132 receiving the $L_{IN}$ signal and a resistor 134 receiving the $(L-R)_{PL}$ signal. This integrator, which provides on its output line 136 a control signal for controlling the left voltage controlled amplifier 580 (FIG. 2b), includes a feedback capacitor 138 connected between the output and the inverting input of the differential amplifier 130. This capacitor controls the response time of the directivity servo. In the first modification described herein this capacitor is decreased by a significant amount, from a value of about 16 micro farads, which has been previously employed in the SRS system when the latter is not used in a surround environment, to a value of about 2.2 micro farads. A similar decrease is made in the feedback capacitor 138a of the right channel integrator 666 which provides on its output line 140 the control signal that is fed back to the right channel voltage controlled amplifier 680 (FIG. 2b). Thus both channels have their response times greatly increased so as to respond more rapidly and also to respond to more rapid fluctuations of sound that appears to emanate from the right or the left of the sound stage. The increased speed of the directivity servos is highly desirable for use of the system in the large areas of a theater where right and left speakers are spaced from each other by a considerable distance. Moreover, the increased speed provides direction enhancement of certain very rapid sound amplitude fluctuations that was not previously available.

However, increasing speed of the directivity servos results in an undesirable and unacceptable "pumping" sound, which in the prior SRS system accompanied rapid operation of the directivity servos. The following discussion will help to explain this "pumping". The center image in the SRS is controlled in part by the directivity servos, as can be seen by the use of the center voltage controlled amplifier 592 (FIG. 2b), which thereby helps to maintain a uniform image. Thus, as side sounds go up because of directivity servo action, the center sound is increased to some extent to help maintain a consistent sound image. However, with too much dynamic fluctuation of the side sounds, as by too fast an action of the directivity servos, the center image of the prior SRS is perceived by the listener as dynamically fluctuating in an undesirable manner. It has been found that this pumping is caused by the presence of the center VCA 592, which previously was driven by an average of the same control signals that drive the left and right voltage controlled amplifiers 580 and 680. The two control signals are fed to the center VCA via resistors 150,152 (FIG. 3), which comprise the averaging or summing circuit 594 of FIG. 2b. From the summing circuit 594 the signals feed to the inverting input of an amplifier 154, having a feedback resistor 156 connected between its output and input. In the prior SRS system this amplifier performs no integration function.

According to a feature of the present invention, the control signal fed from amplifier 154 on its output line 158 to the control of the center VCA is an integration of the control signals that are summed in network 594. This integration function is accomplished by adding a capacitor 160 in a feedback path from the output to the input of the amplifier 154. Accordingly, the center VCA control signal on line 158 does not respond rapidly to the rapid fluctuations of the control signals that are provided to the left and right channel voltage controlled amplifiers, and thereby undesirable pumping is eliminated. In an exemplary embodiment capacitor 160 is about 33 micro farads, resistor 356 is 3.48K ohms, and each of resistors 150 and 152 is 10K ohms.

Additional changes made to the front SRS system are illustrated in the circuitry of FIG. 4, which shows circuit details of portions of the servoed equalizers FIG. 2a. Thus, the left channel signal, (L−R), is fed via a resistor 164 to a differential amplifier 166, having a feedback resistor 168, to peak detector 461 (see FIGS. 2a and 4) which provides to a comparison circuit comprised of a differential amplifier 459 (FIG. 4) to which the peak detected left channel difference signal is fed via a resistor 467. The sum signal is fed via a resistor 169 to an amplifier 170, having a feedback resistor 172, to a peak detector 463 (see also FIG. 2a) which provides via a resistor 465 a second input to a summing network connected to the non-inverting input of differential amplifier 459. In these servoed equalizers the integrators 460 and 484 (FIG. 2a) employ differential amplifiers 458 and 482 (FIG. 4) which receive signals fed to their inverting inputs via threshold switches 457 and 463, respectively. Integrator 460 sums the lower band difference signal (L−R) and the lower band sum signal (L+R) via resistors 456 and 466, and integrator 484 sums the upper band difference signal (L −R) with the upper band sum signal (L+R) via resistors 480 and 486. The signals are fed to the amplifiers via the threshold switches 457 and 463 which are operated in common from the output of amplifier 459 according to a comparison between the difference signal (L−R) and the sum signal (L +R) performed in the resistive summing network 467, 465.

Increased threshold in the front SRS is accomplished by decreasing the value of feedback resistor 168 of the difference signal input of amplifier 166. This provides less amplification of the input difference signal so that comparison circuit 467,465 of amplifier 459 sees a relatively smaller difference signal. In other words, the difference signal input has been amplified so that a difference signal of greater amplitude relative to the sum signal amplitude is required to actuate switches 457,463 via amplifier 459. In the prior SRS system values of the amplitude controlling sum and difference resistors are as follows: R169—20K, R172—100K, R164—20K, and R168—10K. In a preferred embodiment resistor 168 is decreased from 10K to 5.49K, with the other three resistors remaining the same. This reduction achieves a desired increase in difference signal threshold.

In the prior SRS system a threshold switch operates to disable each servoed equalizer, and thereby disable enhancement processing, whenever the stereo component, that is the difference signal, falls below a preselected threshold relative to the sum signal. Accordingly, the comparison circuit, comprised of resistors 467,465, and amplifier 459 (see FIG. 4), as provided in the prior SRS system, will operate to enhance the difference signal when the difference signal amplitude is no less than about one seventh as large as the sum signal amplitude. Should the difference signal amplitude in the prior SRS system be less than one seventh of the sum signal amplitude, switches 457 and 463 are opened to disable the servoed equalizers.

The prior arrangement of the front SRS (but not the rear SRS) is modified for use in the surround system by imposing a higher threshold for the difference signal, such that the difference signal must be at least one quarter to one fifth as large as the sum signal, to maintain the switches 457 and 463 closed and thereby provide the enhancement operation of the servoed equalizers. Should the difference signal in this modified front SRS system fall below a level of about one quarter or one fifth of the sum signal, these switches are opened and servo equalization is disabled. This raised threshold is accomplished by the lowered value of resistor 168.

The purpose of this increased difference signal threshold in the front SRS is to emphasize center signal sound (L+R), particularly where the sound is of relatively low amplitude, as, for example, in spoken voice. Thus the arrangement will direct the listener's attention to the center stage, which normally provides the spoken voice, particularly because, as will be described below, center signal sound (e.g. (L+R)) is not sent to the left and right rear speakers, but is sent primarily to the front center speaker. The increased threshold decreases the amount of enhancement of the right and left difference signals for the front speakers, eliminating the enhancement processing during periods of primarily center state sound. The latter is primarily sum signal, having very little difference signal. However, since, as will be described below, this increased threshold is not employed in the rear SRS system, which has a much lower threshold, the rear system still provides full right channel and left channel ambience, e.g. (L−R) and (R−L), to the left and right rear speakers so that the weakened ambience of the front speakers is not significantly noticed. It must be understood that because of the nature of the enhancement achieved by the servoed equalizers of the SRS system, the left and right channel ambient enhancement as provided to a full extent by the speakers in the rear, produces adequate left and right channel ambient enhancement throughout the theater. This is so because, as previously described, the SRS enhancement eliminates appearance of a point source and provides ambient sound throughout the theater, regardless of seat location. Thus, without significant loss of ambience, a cleaner more commanding center sound signal is provided by increasing the threshold of the front SRS.

Still another modification of the front SRS system, to decrease reverberation effects, is illustrated in FIG. 4. Reverberation signals are often added to sound by sound mixing engineers, but may be undersirably enhanced by the described servoed equalizers of the SRS system. Accordingly, to decrease enhancing of such reverberation, the control signals provided from integrators 460 and 484 (FIG. 4) to the low band and high band voltage controlled amplifiers are allowed to bleed off by adding to the feedback circuits of operational amplifiers 458 and 482, feedback resistors indicated at 190 and 192. These resistors are not present in the prior SRS servoed equalizer integrators, which accordingly may possibly provide an undesirable reverberation component in their output sound. These bleed resistors 190, 192, which may have a value in the order of 1 megohm, will decrease the reverberation without adversely affecting enhancement provided by the SRS system.

The rear SRS system is also modified, but in a manner that is significantly different than the front SRS system. The high pass 250 Hz filters 86 and 110 at inputs to the directivity servos (see FIG. 2*b*) are omitted from the rear SRS system so that the directivity servos will operate on a full band of frequencies. Moreover, to take advantage of the Haas effect, a delay is added, as indicated in blocks 39,45 of FIG. 1. Moreover, the left and right difference signals are provided solely to the left and right rear speakers 40 and 46.

In many theater arrangements the surround or rear speakers are physically closer to the listener than the front speakers, and are located on the perimeter of the normal viewing area. Such proximity to the listener causes dialogue or other sounds (intended to appear to emanate from activity on the screen) to be distracting if the apparent location of such sounds is effectively removed from the screen and shifted to one of the perimeter or rear speakers. To this end, the time delay is added, causing the listeners hearing physiology to disregard the later arrival of an identical sound (from the closer rear speaker) of comparable intensity.

Thus, because it is desired to focus the listener's attention on the screen for the center sound image, the center sound image is not sent to the rear speakers in the surround system disclosed herein. Rather, only left and right difference signals are delivered to the left and right rear speakers.

Band limiting filters 38 and 44 (FIG. 1) are low pass filters, passing the signal below about 10 kilohertz and providing a roll-off at about 10 kilohertz. Prior systems have employed a roll off of considerably less, e.g. about 7 kilohertz. However, because the SRS system provides a curve of amplitude versus frequency that exhibits enhanced amplitude at lower frequencies of about 300 Hz, a frequency band of lowest amplitude at about 2 kilohertz and an increased amplitude upper band at about 7 kilohertz (see FIG. 8 of U.S. Pat. No. 4,866,774), it is desired to include frequencies of 7 kilohertz and slightly higher in the signals sent to the rear speakers. No such band limiting filters need be employed in the front SRS system. High frequencies in general are not desirable in the rear surround speakers, because the ear tends to localize high frequency better than low frequencies, and such highs could distract a listener from the image on the screen at the front. Accordingly, the band pass filters are employed in the output of the rear, but not the front, SRS system. Thus, the rear sound system and speakers give a sense of presence or ambience without strong localization of speaker position.

At least in part because no sum signal is fed to the left and right rear speakers, it is convenient to employ the sum signal provided from the rear SRS system to drive a sub-woofer. Accordingly, the sum signal $(L+R)_{PD}$ from the rear SRS system is fed through low pass filter 48 that will pass frequencies up to but not above 100 hertz to the sub-woofer. As previously mentioned, the sub-woofer has no directionality, and thus may be located any place in the theater and yet will provide good, strong low frequency components.

Again, with regard to modifications of the rear SRS system, the directivity servos response time is decreased, that is, the directivity servo is speeded up in the same manner to the same degree as are the directivity servos of the front SRS systems. However, the center servo of the rear SRS system is not slowed down by integrating the input to its voltage controlled amplifier, as is done in the front SRS system. The center servo is allowed to move rapidly with the increased dynamics of the directivity servo. In other words, the center directivity servo of the front SRS system has a slower response time than the center directivity servo of the rear SRS system. No pumping problem exists because the center channel, which has been found to be a primary cause of the pumping problem, is not used for voice or center sound in the rear SRS, except to drive the very low frequency sub-woofer. Further, the omission of the high pass 250 hertz filters further increases presence and punch of the sub-woofer and rear speaker outputs, which thereby allows low frequency dynamic action to increase on both the sum and difference signals.

Because the same increase in speed of the directivity servos is accomplished for both front and back SRS systems, directivity of the right rear surround sound is enhanced as much as directivity of the right front sound is enhanced. Similarly, directivity of the left rear surround sound is enhanced as much as is directivity of the left front sound. However, since the rear or surround speakers receive no center sound or sum signal, the result is that action appears to stay forward, at the front of the theater, but right and left ambience is increased throughout the theater from front to back.

In general, the described systems will output the desired channels of information, which have a strong and dynamic attention demanding front stage and a directional homogeneous surround rear stage.

What is claimed is:

1. A surround audio system for providing a set of front signals for a set of front speakers and a set of rear signals for a set of rear speakers, said set of front speakers including left, right and center speakers, and said set of rear speakers comprising left, right and sub-woofer speakers, said audio system comprising:

a front audio processing system and a rear audio processing system, wherein each said audio processing system includes left and right directivity servos and a center directivity control, and wherein the center directivity control of said front audio processing system has a response time slower than the response time of the center directivity control of said rear audio processing system each said processing system comprising:

a) means for providing sum and difference signals based on left and right stereo input signals, b) means for boosting amplitudes of components of said difference signal in a band of relatively higher frequencies and in a band of relatively lower frequencies, relative to amplitudes of said sum signal in corresponding bends of higher and lower frequencies respectively, and c) means responsive to said boosted components of said difference signal and to said sum signal for providing left, right and center output signals, means adapted to feed said left and right output signals of said front processing system to left and right front speakers of said front speaker set and to feed said center output signal to said center speaker, and means adapted to feed said left and right output signals of asid rear processing system to left and right speakers of said set of rear speakers and to feed said center output signal to said sub-woofer speaker.

2. The surround system of claim 1 including means for integrating said center directivity control of said front audio processing system.

3. The surround system of claim 2 wherein each directivity servo of said front audio processing system includes a voltage controlled amplifier having a control signal input receiving left and right control signals, including means for combining and integrating said control signal to provide an integrated center control signal, and means for feeding asid integrated center control signal to said center directivity control.

4. A surround audio system for providing a set of front signals for a set of front speakers and a set of rear signals for a set of rear speakers, said set of front speakers including left, right and center speakers, and said set of rear speakers comprising left, right and sub-woofer speakers, said audio system comprising:

a front audio processing system and a rear audio processing system, wherein each said audio processing system includes threshold means for generating a processing enable signal in response to a difference signal having a predetermined minimum magnitude relative to said sum signal, and wherein said minimum magnitude of said front audio system is greater than said minimum of said rear audio system; each said processing system comprising:

a) means for providing sum and difference signals based on left and right stereo input signals, b) means for boosting amplitudes of components of said difference signal in a band of relatively higher frequencies and in a band of relatively lower frequencies, relative to amplitudes of said sum signal in corresponding bands of higher and lower frequencies respectively, and c) means responsive to said boosted components of said difference signal and to said sum signal for providing left, right and center output signals, means adapted to feed said left and right output signals of said front processing system to left and right front speakers of said front speaker set and to feed said center output signal to said center speaker, and means adapted to feed said left and right output signals of said rear processing system to left and right speakers of said set of rear speakers and to feed said center output signal to said sub-woofer speaker.

5. The surround system of claim 4 wherein said threshold means of each said front and rear audio processing system comprises means for amplifying said sum and difference signal and comparing said amplified sum and difference signals, and wherein said difference signal of said front audio processing system is amplified relative to the sum signal of said front and processing system by an amount less than said difference signal of said rear and processing system is amplified relative to said sum signal of said rear audio processing system.

6. A surround audio system for providing a set of front signals for a set of front speakers and a set of rear signals for a set of rear speakers, said set of front speakers including left, right and center speakers, and said set of rear speakers comprising left, right and sub-woofer speakers, said audio system comprising:

a front audio processing system and a rear audio processing system, each said processing system comprising:

a) means for providing sum and difference signals based on left and right stereo input signals, b) means for boosting amplitudes of components of said difference signal in a band of relatively higher frequencies and in a band of relatively lower frequencies, relative to amplitudes of said sum signal in corresponding bands of higher and lower frequencies respectively, wherein said means for boosting amplitudes in said front audio processing system includes first and second servoed equalizers each including a voltage controlled amplifier and a control signal therefore, and means responsive to said amplifiers for generating first and second equalizer control signals for each of said voltage controlled amplifiers, respectively and c) means responsive to said boosted components of said difference signal and to said sum signal for providing left, right and center output signals, means adapted to feed said left and right output signals of said front processing system to left and right front speakers of said front speaker set and to feed said center output signal to said center speaker, and means adapted to feed said left and right output signals of said rear processing system to left and right speakers of said set of rear speakers and to feed said center output signal to said sub-woofer speaker.

7. The surround system of claim 6 wherein said means for generating said first equalizer control signal comprises an operational amplifier having an input and an output, and a feedback resistor connected between said input and output to allow said equalizer control signal to decay, said first equalizer control signal being provided at said operational amplifier output.

8. A surround audio system for providing a set of front signals for a set of front speakers and a set of rear signals for a set of rear speakers, said set of front speakers including left, right and center speakers, and said set of rear speakers comprising left, right and sub-woofer speakers, said audio system comprising:

a front audio processing system and a rear audio processing system, wherein each said audio processing system includes left and right directivity servo means for enhancing directionality of said boosted components, and wherein said directivity servo means of said front audio processing system include high pass filter means for preventing said servo means from enhancing directionality in frequencies below a predetermined frequency, and wherein said directivity servos of said rear audio processing system include means for causing said servos to enhance directionality in a frequency band that includes frequencies below said predetermined frequency each said processing system comprising:

a) means for providing sum and difference signals based on left and right stereo input signals, b) means for boosting amplitudes of components of said difference signal in a band of relatively higher frequencies and in a band of relatively lower frequencies, relative to amplitudes of said sum signal in corresponding bands of higher and lower frequencies respectively, and c) means responsive to said boosted components of said difference signal and to said sum signal for providing left, right and center output signals, means adapted to feed said left and right output signals of said front processing system to left and right front speakers of said front speaker set and to feed said center output signal to said center speaker, and means adapted to feed said left and right output signals of said rear processing system to left and right speakers of said set of rear speakers and to feed said center output signal to said sub-woofer speaker.

9. A stereo enhancement system comprising:

means for providing sum and difference signals representing respectively the sum of and difference between left and right stereo input signals, means for processing the sum and difference signals to provide processed sum and difference signals, left servo means responsive to change in amplitude of said left input signal and to a directivity enhanced left signal for varying amplitude of said left processed difference signal to provide said directivity enhanced left signal, right servo means responsive to change in amplitude of said right input signal and to a directivity enhanced right signal for varying amplitude of said right processed signal to provide said directivity enhanced right signal, said left and right servo means including means for generating left and right servo control signals that fluctuate with said left and right input signals, center signal control means responsive to said sum signal for amplifying said sum signal to provide an enhanced center signal, means responsive to said left and right servo control signals for generating a center control signal that fluctuates in response to fluctuation of said left and right servo control signals, means for decreasing frequency of fluctuation of said center control signal relative to frequency of fluctuation of said left and right control signals, and means for applying said center control signal to said center signal control means for varying amplitude of said enhanced center signal.

10. The stereo image enhancement system of claim 9 wherein each of said left and right servo means comprises a voltage controlled amplifier having a control input, having one of said left and right processed difference signals as a signal input and providing an associated one of said directivity enhanced left and right signals as an output, means for generating a feedback signal indicative of the difference between the signal input and the output of the amplifier, means for comparing the feedback signal with one of the stereo input signals to provide said servo control signal, and means for feeding the servo control signal to the control input of the amplifier, said means for generating said center control signal comprising means for combining said left and right servo control signals and means for integrating said combined signals to provide said center control signal.

11. The system of claim 9 wherein said means for generating said center control signal comprises a resistive summing network having an output, an operational amplifier having an input connected to said summing network output, and having an amplifier output, a resistor connected in a first feedback path from the amplifier output to said input, and a capacitor connected in a second feedback path from said output to said input.

12. The system of claim 9 wherein said means for generating said center control signal comprises means for combining said left and right servo control signals, and means for integrating said combined signals to provide said center control signal.

* * * * *